US007902764B2

(12) United States Patent
Giussani et al.

(10) Patent No.: US 7,902,764 B2
(45) Date of Patent: Mar. 8, 2011

(54) CONTROL DEVICE FOR DISCHARGE LAMP

(75) Inventors: Luca Giussani, San Vittore Olona (IT); Luca Salati, Milan (IT)

(73) Assignee: STMicroelectronics S.R.L., Agrate Brianza (MI) (IT)

( * ) Notice: Subject to any disclaimer, the term of this patent is extended or adjusted under 35 U.S.C. 154(b) by 504 days.

(21) Appl. No.: 11/913,368

(22) PCT Filed: May 4, 2005

(86) PCT No.: PCT/IT2005/000258

§ 371 (c)(1),
(2), (4) Date: May 6, 2008

(87) PCT Pub. No.: WO2006/117809

PCT Pub. Date: Nov. 9, 2006

(65) Prior Publication Data

US 2009/0121639 A1 May 14, 2009

(51) Int. Cl.
*H05B 37/02* (2006.01)

(52) U.S. Cl. ..... 315/224; 315/225; 315/226; 315/291; 315/307

(58) Field of Classification Search ..... 315/209 R, 315/224, 225, 226, 283, 291, 307, 308
See application file for complete search history.

(56) References Cited

U.S. PATENT DOCUMENTS

| | | | | |
|---|---|---|---|---|
| 5,475,284 | A | 12/1995 | Lester et al. | |
| 5,565,740 | A * | 10/1996 | Hiramatsu et al. | 315/209 R |
| 5,883,473 | A * | 3/1999 | Li et al. | 315/225 |
| 5,969,482 | A * | 10/1999 | Gradzki | 315/224 |
| 6,288,500 | B1 | 9/2001 | Klier | |
| 6,362,575 | B1 | 3/2002 | Chang et al. | |
| 2005/0001558 | A1 | 1/2005 | Buij et al. | |

FOREIGN PATENT DOCUMENTS

EP 1 322 142 A1 6/2003

* cited by examiner

*Primary Examiner* — Thuy Vinh Tran
(74) *Attorney, Agent, or Firm* — William J. Kubida; Peter J. Meza; Hogan & Lovells US LLP

(57) ABSTRACT

A driving method for a discharge lamp having two cathodes includes providing a supply input voltage for providing an alternating voltage at the terminals of the cathodes, monitoring a condition of each of the cathodes and measuring a first direct voltage signal of the waveform of the voltage of the lamp that develops when the lamp approaches an ageing condition, deactivating the alternating voltage when a variation of the first direct voltage signal occurs, and supplying a second direct voltage signal proportional to the supply input voltage for deactivating the alternating voltage when a variation of the first direct voltage signal occurs in relation to the second direct voltage signal.

16 Claims, 4 Drawing Sheets

CONTROL DEVICE FOR DISCHARGE LAMP

CROSS-REFERENCE TO RELATED APPLICATIONS

The present application is a U.S. national filing of PCT/IT2005/000258 filed May 4, 2005, which is incorporated herein in its entirety by this reference.

FIELD OF THE INVENTION

The present invention refers to a device for driving discharge lamps, in particular fluorescent lamps.

BACKGROUND OF THE INVENTION

Fluorescent lamps are typically composed of a glass tube which contains a small quantity of mercury, a low pressure, inert gas and phosphorous powders which coat the inside part of the tube. At the extremities two electrodes are present which, connected to a suitable driving circuit, create the arc that permits the discharge of the gas to be generated and maintained.

Among the possible driving circuits the so-called high frequency ballast circuits can be enumerated: these are circuits at whose output an alternating voltage signal is generated at a frequency and amplitude necessary to keep the lamp on; this waveform is produced by a circuit that comprises a couple of transistors that switch at a frequency of tens of KHz, a current limiting coil and a filtering capacitance.

When the ageing condition of the lamp approaches, the voltage at the extremities of the same will tend to increase because of the depletion of the emissive coating on the cathodes with the consequent increase in the drop in voltage at their ends. It is common that this phenomenon comes about asymmetrically as one cathode ages before the other; this phenomenon takes the name of "rectifying effect".

The resulting increase of power dissipated in the lamp could lead to an excessive overheating with dangerous consequences such as the fusion of the glass that surrounds the lamp itself; for this reason the ballast circuits must detect this failure condition, when it exceeds a certain level, and undertake suitable preventive measures such as turning off the ballast.

Various attempts have been made to prevent the overheating of the lamp due to the ageing such as in the EP patent 0 681 414. In said patent a ballast circuit for a discharge lamp 10 is described having two cathodes (FIG. 1) in which the ballast circuit comprises an inverter 1, driven by a device 11, that provides for an alternated voltage at its output terminals; the inverter 1 is fed through a voltage Val coming from a PFC or from a rectification stage 100 fed in turn by the mains voltage Vin. The ballast comprises a circuitry 2 to couple the discharge lamp 10 to said output terminals, another circuitry 3 that measures a direct voltage component Vdc1 at the ends of the blocking capacitor C1 placed between the lamp and ground GND and means 4 suitable for deactivating the inverter 1 when the lamp approaches the ageing conditions. In the means 4 the measured direct component Vdc1 is compared with a signal Vdcm referred to ground GND and produced by means 5; when said component Vdc1 is less or greater than the signal Vdcm by a given value, the means 4 turn off the inverter 1 by acting on the device 11 through a signal Dis.

The proposed solution does not consider a problem linked mainly to the variations of the input voltage of the inverter, whether it be the mains voltage rectified or the output of a stage of the power factor correction (PFC). These variations can be due to low values of the input capacity of the inverter, to short interruptions of the mains voltage that cause a voltage drop or to transitory phenomena that cause its variation. In addition an oscillation at a frequency equal to twice the mains voltage frequency is overlaid to the direct value of the input voltage of the inverter; the amplitude of this oscillation is inversely proportional to the value of the capacity (electrolytic) placed downstream of the rectifier stage (normally a diode bridge) or of the PFC.

The circuitry proposed in the abovementioned patent also intervenes in presence of one of the abovementioned variations of the inverter input voltage, even though the lamp does not present any type of ageing condition.

SUMMARY OF THE INVENTION

In view of the state of the technique described, the object of the present invention is to provide a device for driving discharge lamps that overcomes the abovementioned inconvenience.

In accordance with the present invention, this object is achieved by means of a driving device for a discharge lamp having two cathodes, comprising first means having a supply input voltage and suitable for providing an alternating voltage at the terminals of said cathodes, second means capable of monitoring a condition of each of said cathodes and suitable for measuring a first direct voltage signal of the voltage waveform of the lamp that is developed when said lamp approaches the ageing condition, third means coupled to said second means and suitable for deactivating said first means when a predetermined variation of said first direct voltage signal occurs, characterised in that it comprises fourth means suitable for supplying to said third means a second direct voltage signal proportional in value to said supply voltage, said third means being suitable for deactivating said first means when a predetermined variation of said first direct voltage signal in relation to said second direct voltage signal occurs.

Thanks to the present invention it is possible to produce a driving device for a discharge lamp that prevents the substitution of the discharge lamp in presence of variations of the supply voltage of the same driving device.

BRIEF DESCRIPTION OF THE DRAWINGS

The characteristics and the advantages of the present invention will appear evident from the following detailed description of an embodiment thereof, illustrated as non-limiting example in the enclosed drawings, in which.

DETAILED DESCRIPTION OF PREFERRED EMBODIMENTS

Figure 1:
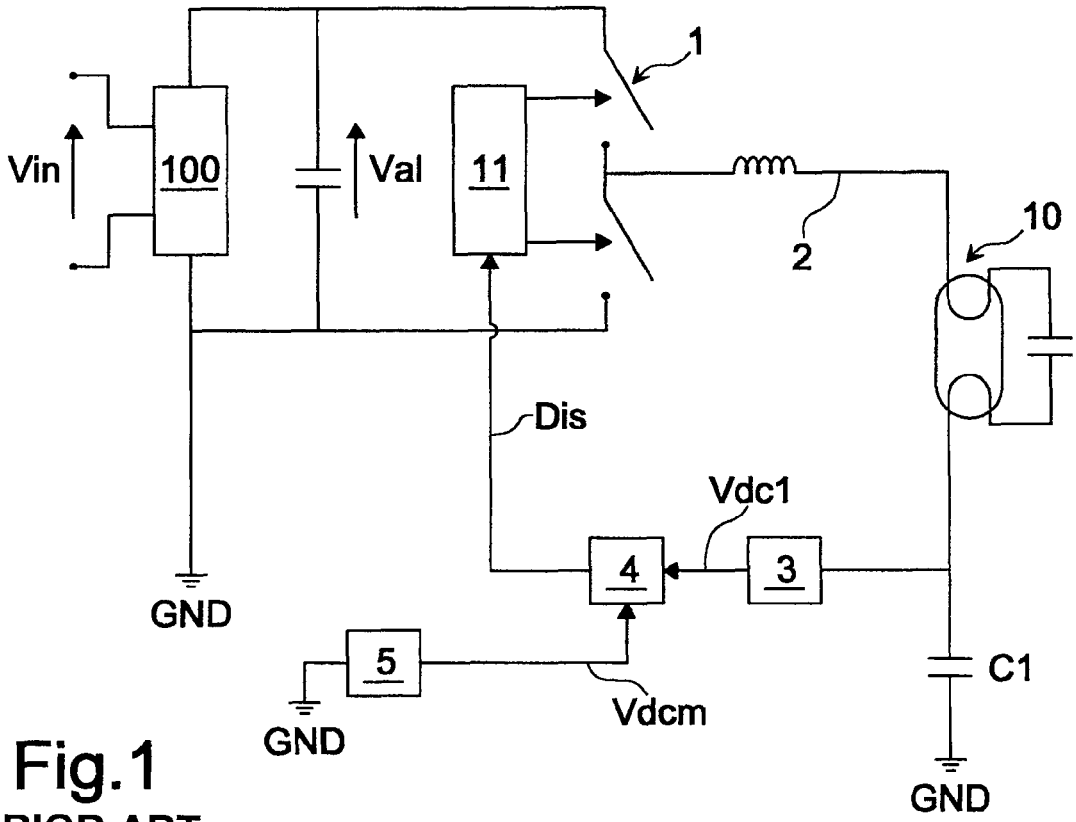
Fig.1 PRIOR ART
FIG. 1 is a circuit diagram of an apparatus for driving a discharge lamp according to the known art.
Figure 2:
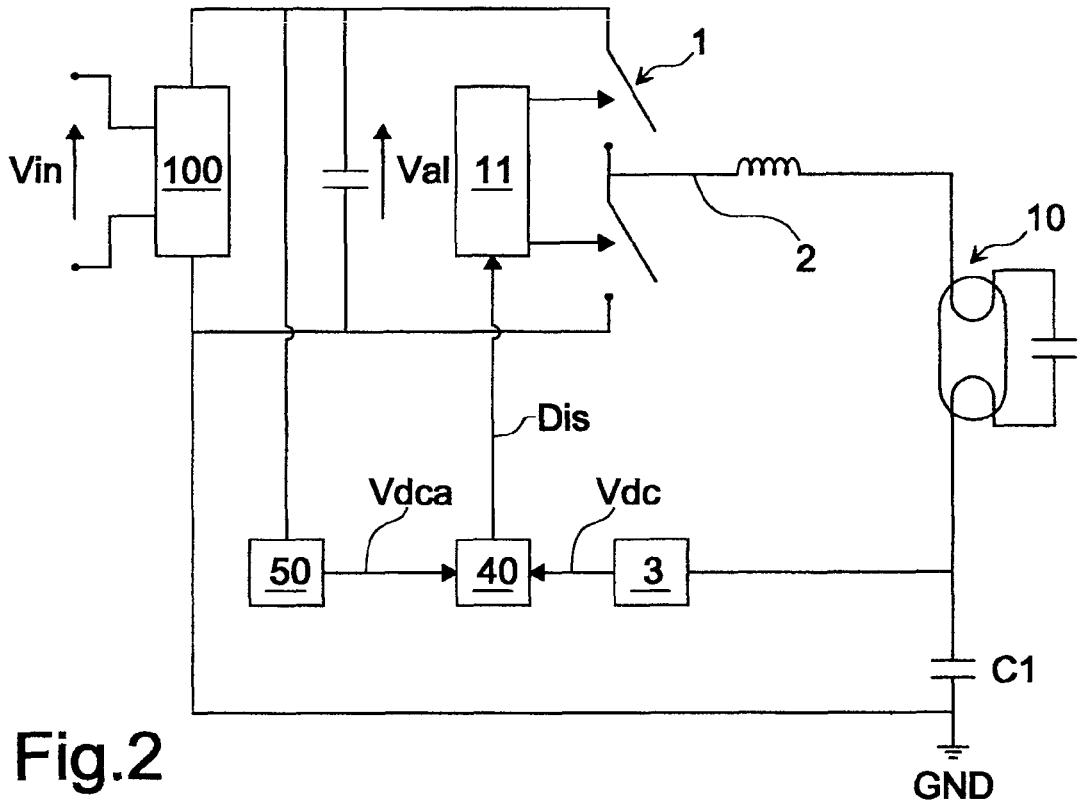
FIG. 2 is a circuit diagram of a device for driving a fluorescent lamp according to the present invention.

In FIG. 2 a driving device for a discharge lamp, in particular for a fluorescent lamp, according to the present invention is described; the elements equal to those of the circuit shown in FIG. 1 will be indicated with the same numerical references. The driving device of FIG. 2, preferably a ballast circuit, provides for driving a fluorescent lamp 10 having two cathodes. The ballast circuit comprises an inverter 1, driven by a device 11, that provides for an alternating voltage on its output terminals; the inverter 1 is fed by a voltage Val coming from a device for the power factor correction (PFC) or from a rectification stage 100 fed in turn by the mains voltage Vin. The ballast circuit comprises a circuitry 2 to couple the fluorescent lamp 10 to said output terminals, another circuitry 3 that measures a direct voltage component Vdc at the ends of the blocking capacitor C1 placed between the lamp and ground GND and means 40 suitable for deactivating the inverter 1 when the lamp approaches the ageing ("end of life") conditions, that is when a depletion of the emissive coating of one of the cathodes of the same lamp occurs, so as to prevent excessive heating of said cathode.

The driving circuit comprises means 50 suitable for supplying a direct voltage component Vdca depending on said supply voltage Val, more precisely aligned or proportional in value to said supply voltage Val.

In the means 40 the measured direct component Vdc is compared with the signal Vdca; when said component Vdc is lower or higher than the signal Vdca by a given value D the means 40 provide for turning off the inverter 1 by acting on the device 11 through a signal Dis. Said given value D is, for example, within a field of variation between 2 and 52 volts.

Figure 3:
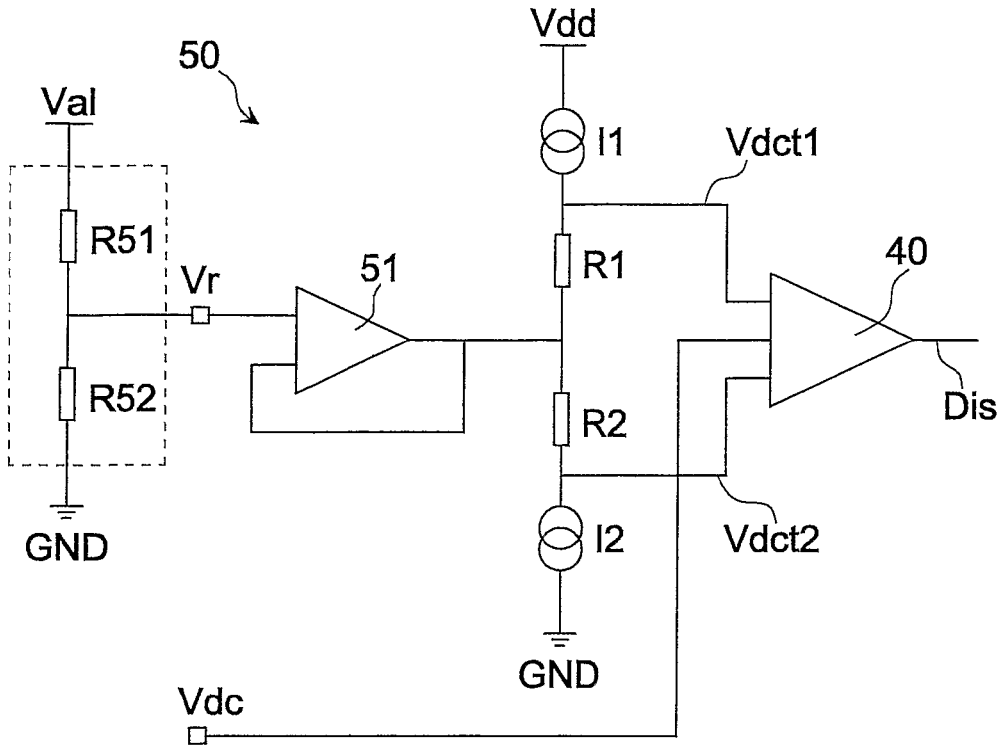
FIG. 3 is a more detailed circuit diagram of a part of the control device of FIG. 2.

In FIG. 3 the means 40 and 50 are shown more in detail. The means 50 comprise a device capable of supplying a voltage signal proportional to the voltage Val, preferably a resistive divider comprising two resistors R51 and R52 arranged in series between the supply voltage Val and ground GND. The common terminal of the two resistors R51 and R52 is the input terminal of a buffer 51 and on said terminal there is the signal Vr; the output terminal of the buffer 51 is the common terminal of two resistors R1 and R2 having the other terminals connected respectively to two current generators I1 and I2 in turn connected respectively to a supply voltage Vdd and to ground GND. The threshold voltages Vdct1 and Vdct2 are taken respectively on the common terminal of the resistor R1 and of the current generator I1 and on the common terminal of the resistor R2 and of the current generator I2; said voltages Vdct1 and Vdct2 are in input to the means 40. The latter comprise a comparator having in input the voltages Vdct1, Vdct2 and Vdc. The threshold voltages Vdct1 and Vdct2 represent the reference voltage Vdca of the means 40 that depends on the supply voltage Val; in fact the voltages Vdct1 and Vdct2 depend on the voltage Vr that varies in accordance with a variation of the voltage Val.

Figure 4:
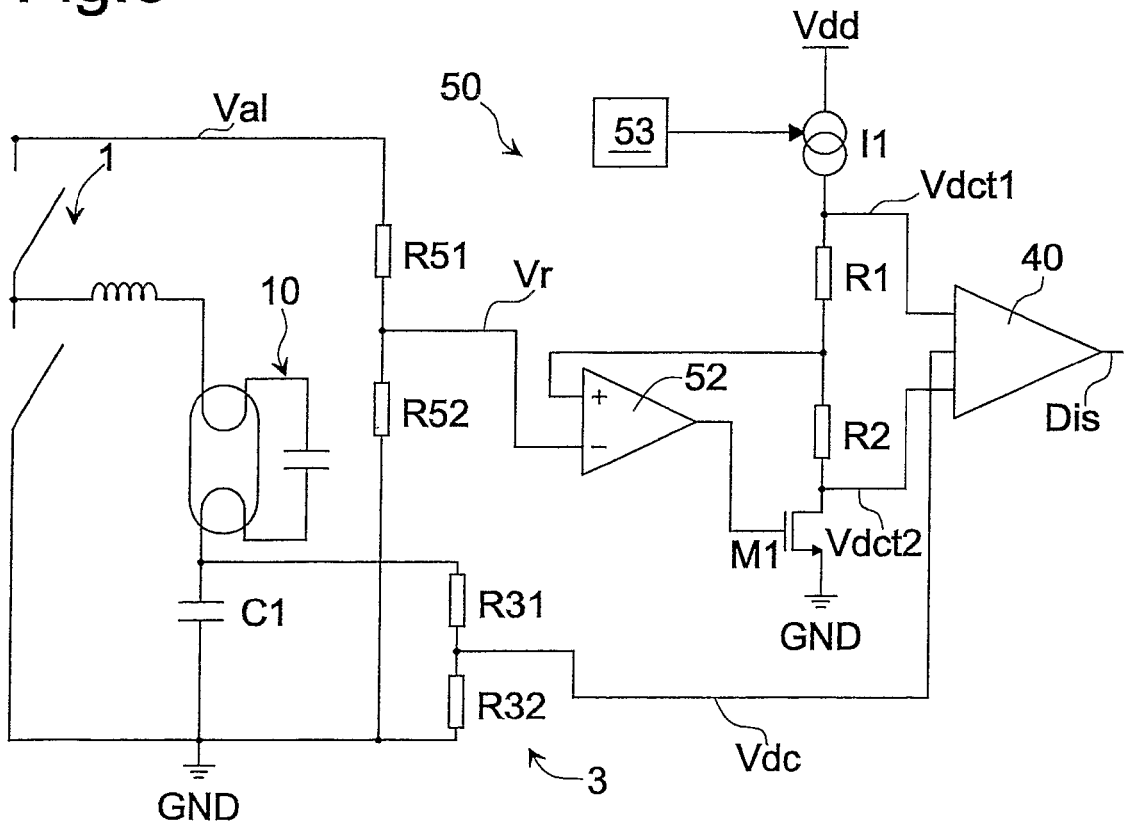
FIG. 4 is an even more detailed circuit diagram of a part of the device of FIG. 2.

In FIG. 4 an even more detailed circuit diagram of a part of the device of FIGS. 2 and 3 is shown. The circuitry 3 comprises a series of two resistors R31, R32 placed at the ends of the capacitor C1; the signal detected on the common terminal of the two resistors R31, R32 is the signal Vdc that is in input to the means 40, more precisely in input to the comparator. The means 50 comprise a resistive divider comprising two resistors R51 and R52 arranged in series between the supply voltage Val and ground GND. The common terminal of the two resistors R51 and R52 is the inverting input terminal of an operational amplifier 52 and on said terminal there is the signal Vr; the output terminal of the operational amplifier 52 is the gate terminal of the transistor M1 having the source terminal connected to ground GND and the drain terminal connected to a terminal of a resistor R2. The latter has its other terminal connected to the non-inverting terminal of the operational amplifier 52 and to the resistor R1 having its other terminal connected to a current generator I1; preferably said current generator I1 is controlled by a circuit bandgap 53 to obtain a precise current reference. The threshold voltages Vdct1 and Vdct2 are taken respectively at the common terminals of the resistor R1 and of the current generator I1 and of the resistor R2 and of the transistor M1 and are in input to the comparator of the means 40. The threshold voltages Vdct1 and Vdct2 represent the reference voltage Vdca of the means 40 that depends on the supply voltage Val; in fact the voltages Vdct1 and Vdct2 depend on the voltage Vr that varies in accordance with a variation of the voltage Val.

Preferably the resistors R31, R32, R51 and R52 are sized so that Vdc=Vr when the fluorescent lamp 10 is new.

Preferably the current generator I1 is such that I1=f(b) and the resistors R1 and R2 are chosen so that R1=(L1/W1)*b and R2=(L2/W2)*b where with L1, L2 the length of the resistive component R1, R2 is indicated and with W1, W2 the width of said resistive component.

Figure 5:
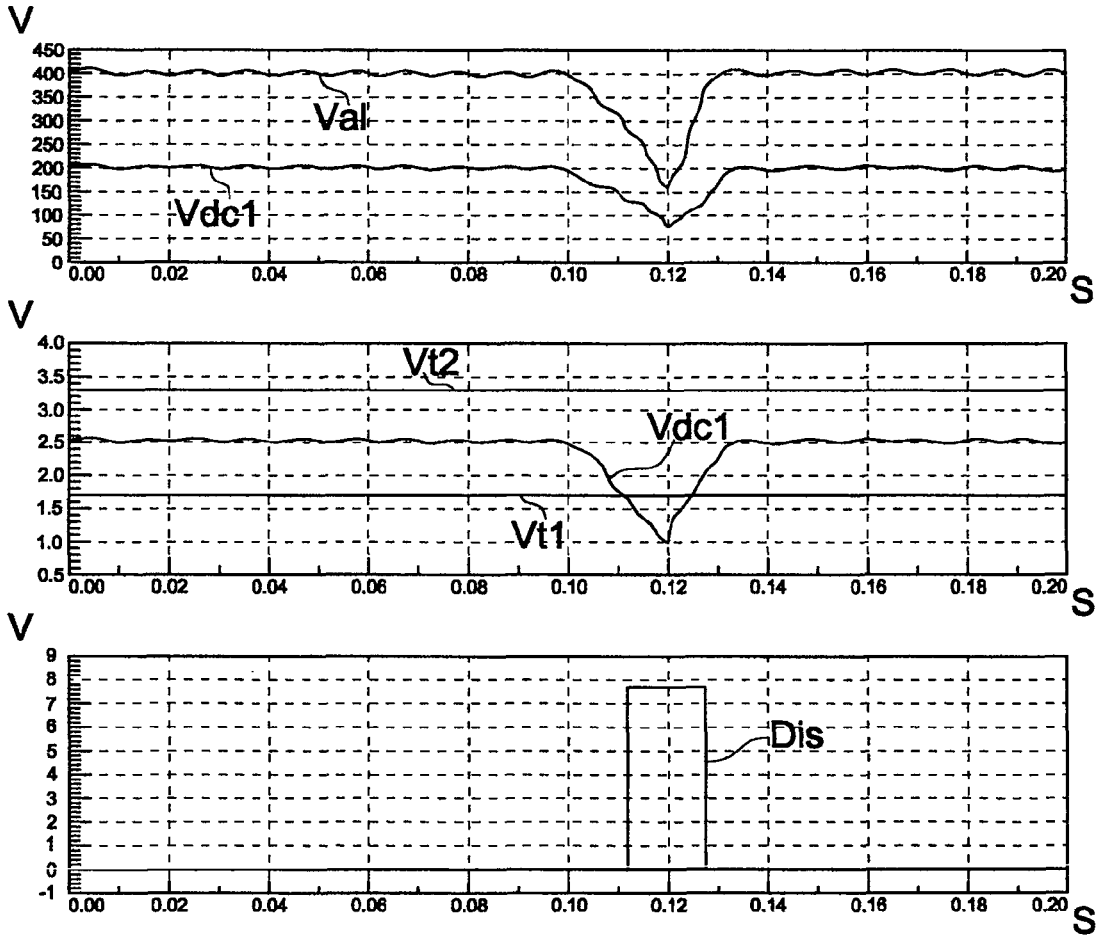
Fig.5 PRIOR ART
FIG. 5 is a time diagram of signals present in the apparatus of FIG. 1 according to the known art.

In FIG. 5 a time diagram of signals in question in the circuit of FIG. 1 according to the known art is shown. We note that a variation of the supply voltage Val causes a similar variation of the voltage Vdc1. If we consider that the reference signal Vdcm is constituted by two fixed threshold voltages, a threshold voltage exceeding Vt2 and a threshold voltage lower than Vt1, we note how the variation of the voltage Vdcm causes a lowering of the same voltage Vdc1 below the threshold voltage Vt1. This causes the signal Dis to be sent to deactivate the device 11. In this manner the ballast circuit according to the known art operates in an incorrect manner given that it turns off the fluorescent lamp 10 not in presence of an ageing condition of the same but in presence of a variation of the supply voltage Val.

Figure 6:
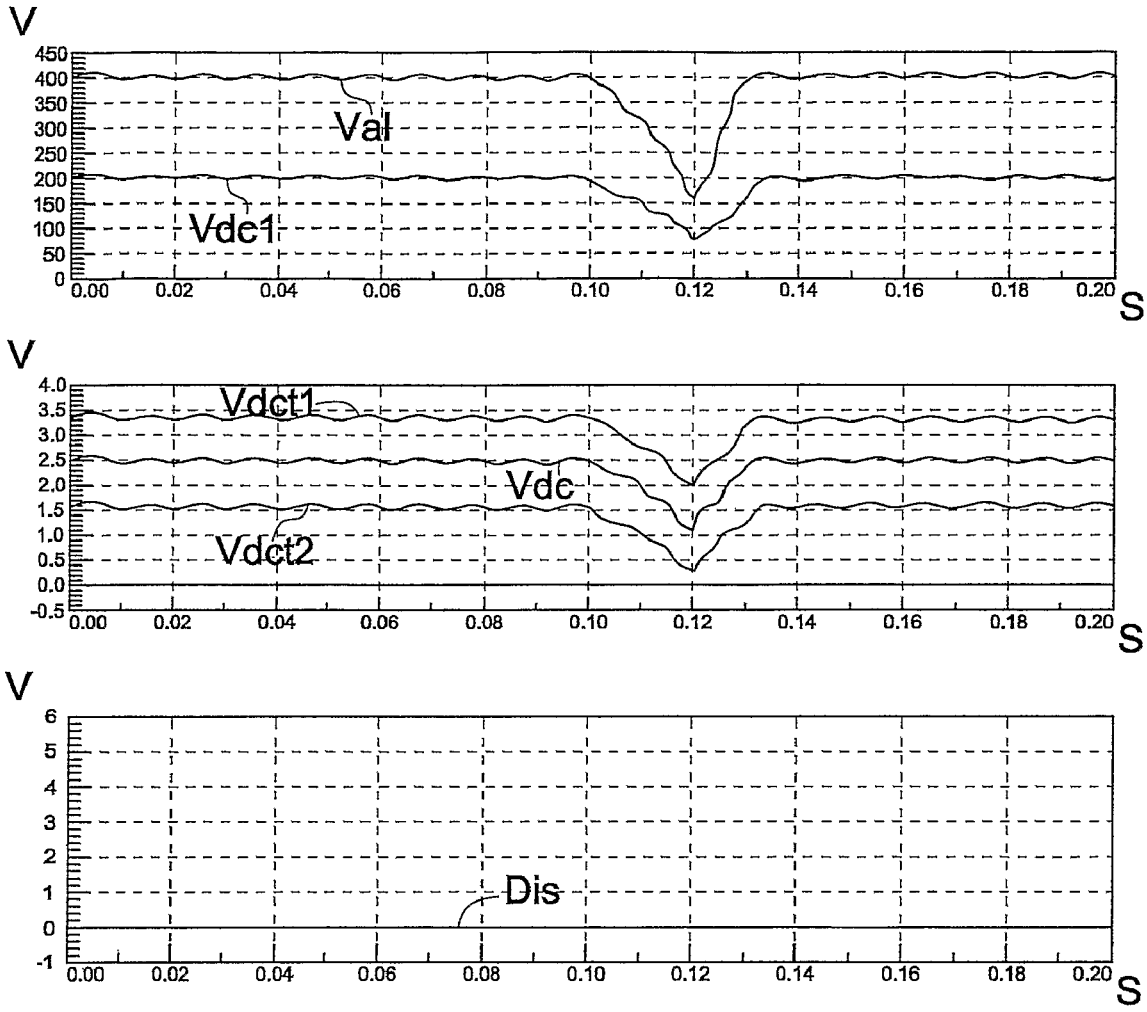
FIG. 6 is a time diagram of signals in question in the driving device of FIG. 4.

This does not occur with the driving circuit in accordance with the present invention. In fact, as can be seen in FIG. 6, a variation of the supply voltage Val causes a similar variation of the voltage Vdc but not the sending of the signal Dis to the circuitry 11. The variation of the voltage Val also causes a similar variation of the threshold voltages Vdct1 and Vdct2, so that the voltage Vdc does not go lower than the threshold voltage Vdct1. The signal Dis remains therefore a nil signal. In this manner the driving circuit according to the invention operates correctly given that it does not turn off the fluorescent lamp 10 in presence of a variation of the supply voltage Val.

The invention claimed is:

1. Driving device for a discharge lamp having two cathodes, comprising first means having a supply input voltage, for providing an alternating voltage at the terminals of said cathodes, second means for monitoring a condition of each of said cathodes and measuring a first direct voltage signal of the waveform of a voltage of the lamp that develops when said lamp approaches an ageing condition, third means coupled to said second means for deactivating said first means when a predetermined variation of said first direct voltage signal occurs, fourth means for supplying to said third means a second direct voltage signal proportional in value to said supply voltage, said third means being further operable for deactivating said first means when a predetermined variation of said first direct voltage signal occurs in relation to said second direct voltage signal, wherein said second direct voltage signal comprises a first component and a second component, said first and said second component forming respectively a higher threshold voltage and a lower threshold voltage for said first direct voltage signal.

2. The driving device according to claim 1, wherein said supply input voltage is an output voltage of a rectifier stage for the mains voltage.

3. The driving device according to claim 1, wherein said supply input voltage is an output voltage of a device for the power factor correction having an input receiving the mains voltage.

4. The driving device according to claim 1, wherein said driving device is a ballast circuit and said first means comprises an inverter and driving means of the inverter.

5. The driving device according to claim 1, wherein said fourth means comprises a resistive divider placed between said supply input voltage and a reference voltage, the output voltage signal from said resistive divider being used to obtain said higher threshold voltage and said lower threshold voltage.

6. The driving device according to claim 5, wherein said fourth means comprises a buffer having an input receiving said output voltage signal from the resistive divider, a first and a second resistor having a common terminal connected to said buffer and means for generating a current that flows in said first and said second resistor, the voltage signals detected on the terminals not in common of said first -and said second resistor being said higher threshold voltage and said lower threshold voltage.

7. A driving device for a discharge lamp having two cathodes, comprising:

a first circuit having a supply input voltage for providing an alternating voltage at the terminals of said cathodes;

a second circuit for monitoring a condition of each of said cathodes and measuring a first direct voltage signal of a waveform of the voltage of the lamp that develops when said lamp approaches an ageing condition;

a third circuit coupled to said second circuit for deactivating said first circuit when a predetermined variation of said first direct voltage signal occurs; and a fourth circuit for supplying to said third circuit a second direct voltage signal proportional in value to said supply input voltage, said third circuit being further operable for deactivating said first circuit when a predetermined variation of said first direct voltage signal occurs in relation to said second direct voltage signal, wherein said second direct voltage signal comprises a first component and a second component, said first and said second component forming respectively a higher threshold voltage and a lower threshold voltage for said first direct voltage signal.

8. The driving device according to claim 7, wherein said supply input voltage comprises an output voltage of a rectifier stage for the mains voltage.

9. The driving device according to claim 7, wherein said supply input voltage comprises an output voltage of a device for power factor correction having an input receiving the mains voltage.

10. The driving device according to claim 7, wherein said driving device comprises a ballast circuit and said first circuit comprises an inverter and a driving circuit of the inverter.

11. The driving device according to claim 7, wherein said fourth circuit comprises a resistive divider placed between said supply input voltage and a reference voltage, the output voltage signal from said resistive divider being used to obtain said higher threshold voltage and said lower threshold voltage.

12. The driving device according to claim 11, wherein said fourth circuit comprises a buffer having an input receiving said output voltage signal from the resistive divider, a first and a second resistor having a common terminal connected to said buffer and a circuit for generating a current that flows in said first and said second resistor, the voltage signals detected on the terminals not in common of said first and said second resistor comprising said higher threshold voltage and said lower threshold voltage.

13. A driving method for a discharge lamp having two cathodes, comprising:

providing a supply input voltage for providing an alternating voltage at the terminals of said cathodes;

monitoring a condition of each of said cathodes and measuring a first direct voltage signal of a waveform of the voltage of the lamp that develops when said lamp approaches an ageing condition;

deactivating said alternating voltage when a predetermined variation of said first direct voltage signal occurs; and supplying a second direct voltage signal proportional in value to said supply input voltage for deactivating said alternating voltage when a predetermined variation of said first direct voltage signal occurs in relation to said second direct voltage signal, wherein said second direct voltage signal comprises a first component and a second component, said first and said second component forming respectively a higher threshold voltage and a lower threshold voltage for said first direct voltage signal.

14. The method according to claim 13, further comprising placing a resistive divider between said supply input voltage and a reference voltage, the output voltage signal from said resistive divider being used to obtain said higher threshold voltage and said lower threshold voltage.

15. The method according to claim 14, further comprising providing a buffer having an input receiving said output voltage signal from the resistive divider, a first and a second resistor having a common terminal connected to said buffer.

16. The method according to claim 15 further comprising generating a current that flows in said first and said second resistor, the voltage signals detected on the terminals not in common of said first and said second resistor being said higher threshold voltage and said lower threshold voltage.

* * * * *